US009148924B2

(12) United States Patent
Zijlman

(10) Patent No.: US 9,148,924 B2
(45) Date of Patent: Sep. 29, 2015

(54) DRIVING A LIGHT EMITTING DIODE CIRCUIT

(75) Inventor: Theo Gerrit Zijlman, Tilburg (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/236,969

(22) PCT Filed: Aug. 2, 2012

(86) PCT No.: PCT/IB2012/053958

§ 371 (c)(1),
(2), (4) Date: Apr. 9, 2014

(87) PCT Pub. No.: WO2013/021320

PCT Pub. Date: Feb. 14, 2013

(65) Prior Publication Data

US 2014/0210367 A1 Jul. 31, 2014

Related U.S. Application Data

(60) Provisional application No. 61/521,061, filed on Aug. 8, 2011.

(51) Int. Cl.
*H05B 33/08* (2006.01)

(52) U.S. Cl.
CPC ..... *H05B 33/083* (2013.01); *H05B 33/086* (2013.01); *H05B 33/0866* (2013.01)

(58) Field of Classification Search
None
See application file for complete search history.

(56) References Cited

U.S. PATENT DOCUMENTS 7,531,971 B2 * 5/2009 Weng ..... 315/291
2006/0261752 A1 * 11/2006 Lee ..... 315/291
2006/0273331 A1 12/2006 Lim et al.
2007/0236155 A1 * 10/2007 Kao et al. ..... 315/247
2010/0066255 A1 3/2010 Roberts
2010/0102750 A1 * 4/2010 Cheon et al. ..... 315/291
2010/0194274 A1 8/2010 Hoogzaad
2010/0244707 A1 9/2010 Gaines et al.
2011/0121743 A1 * 5/2011 Hsiung ..... 315/224
2011/0309757 A1 * 12/2011 Weaver et al. ..... 315/188

FOREIGN PATENT DOCUMENTS

CN 1816234 A 8/2006
DE 3832109 A1 3/1990
WO 2009013676 A2 1/2009
WO 2010046065 A1 4/2010
WO 2011037774 A2 3/2011

* cited by examiner

*Primary Examiner* — Crystal L Hammond
(74) *Attorney, Agent, or Firm* — Yuliya Mathis

(57) ABSTRACT

An apparatus for driving a light emitting diode circuit (1) comprises first and second terminals (11,12) to be connected to the light emitting diode circuit (1), a capacitor (31) connected to the first and second terminals (11,12), a switch (41) for, in a conducting mode, bypassing the light emitting diode circuit (1), and a diode (51) for, in the conducting mode, preventing the capacitor (31) from being discharged via the switch (41). In this way, a reduced switch-on delay is realized without an additional switch being required for activating and deactivating said capacitor (31). The diode (51) is simpler and cheaper and more robust than such an additional switch and does not require a control. Preferably, the apparatus comprises a further terminal (13), wherein the diode (51) is connected to the further terminal (13) and to one of the first and second terminals (11,12), and the switch (41) is connected to the further terminal (13) and to the other one of the first and second terminals (11,12).

8 Claims, 2 Drawing Sheets

DRIVING A LIGHT EMITTING DIODE CIRCUIT

FIELD OF THE INVENTION

The invention relates to an apparatus for driving a first light emitting diode circuit. The invention further relates to a device comprising the apparatus and the first light emitting diode circuit.

Examples of such a device are lamps and other consumer and/or professional products that provide light via light emitting diode circuits.

BACKGROUND OF THE INVENTION

US 2010/0194274 discloses in general a light emitting diode arrangement with bypass driving and discloses more in particular in FIG. 9A a first light emitting diode circuit 10, a first switch 12 for, in a first conducting mode, bypassing the first light emitting diode circuit 10, and a serial connection of a first capacitor 13 and an additional switch 14. The additional switch 14 prevents, in the first conducting mode, the first capacitor 13 from being discharged via the first switch 12. As described in the paragraphs 0091, 0100 and 0101, the first capacitor 13 needs to be prevented from being discharged via the first switch 12 to reduce switch-on delay.

SUMMARY OF THE INVENTION

It is an object of the invention to provide an improved apparatus. Further objects of the invention are to provide devices each comprising an improved apparatus.

According to a first aspect, an apparatus is provided for driving a first light emitting diode circuit, the apparatus comprising first and second terminals to be connected to the first light emitting diode circuit, a first capacitor connected to the first and second terminals, a first switch for, in a first conducting mode, bypassing the first light emitting diode circuit, and a first diode for, in the first conducting mode, preventing the first capacitor from being discharged via the first switch.

The apparatus comprises a first diode for, in the first conducting mode, preventing the first capacitor from being discharged via the first switch. Such a first diode is simpler and cheaper and more robust than an additional switch and does not require a control. These are great advantages that show that an improved apparatus has been created.

An embodiment of the apparatus is defined in that it further comprises a further terminal, the first diode being connected to the further terminal and to one of the first and second terminals, and the first switch being connected to the further terminal and to the other one of the first and second terminals. This is an advantageous construction.

An embodiment of the apparatus is defined in that the apparatus is further arranged for driving a second light emitting diode circuit, the apparatus further comprising third and fourth terminals to be connected to the second light emitting diode circuit, a second capacitor connected to the third and fourth terminals, a second switch for, in a second conducting mode, bypassing the second light emitting diode circuit, and a second diode for, in the second conducting mode, preventing the second capacitor from being discharged via the second switch.

An embodiment of the apparatus is defined in that it further comprises a yet further terminal, the second diode being connected to the yet further terminal and to one of the third and fourth terminals and the second switch being connected to the yet further terminal and to the other one of the third and fourth terminals.

An embodiment of the apparatus is defined by the first and second light emitting diode circuits providing light of different color temperatures, the apparatus further comprising a controller for controlling the first and second switches in response to information for creating an overall color temperature that is independent of a component temperature and/or a dimming mode.

The information may be derived from a table or from a measurement of an overall light intensity or from measurements of individual light intensities per light emitting diode circuit or from a measurement of an overall current or from measurements of individual currents per light emitting diode circuit etc.

According to a second aspect, a device is provided comprising the apparatus as defined above and further comprising the first light emitting diode circuit. Preferably, the first light emitting diode circuit comprises one light emitting diode or two or more light emitting diodes connected to each other. This may be a serial connection, a parallel connection, or a combination of both.

According to a third aspect, a device is provided comprising the apparatus as defined above and further comprising the first and second light emitting diode circuits. Preferably, each one of the first and second light emitting diode circuits comprises one light emitting diode or two or more light emitting diodes connected to each other. This may be a serial connection, a parallel connection, or a combination of both.

An insight could be that an additional switch is more complex and more expensive and requires a control, and a basic idea could be that such an additional switch is to be replaced by a diode that is simpler and cheaper and more robust and does not require a control.

The problem of providing an improved apparatus has been solved. An advantage could be that the apparatus is simpler and cheaper and more robust and does not require a control for an additional switch.

These and other aspects of the invention will be apparent from and elucidated with reference to the embodiments described hereinafter.

DETAILED DESCRIPTION OF EMBODIMENTS

Figure 1:
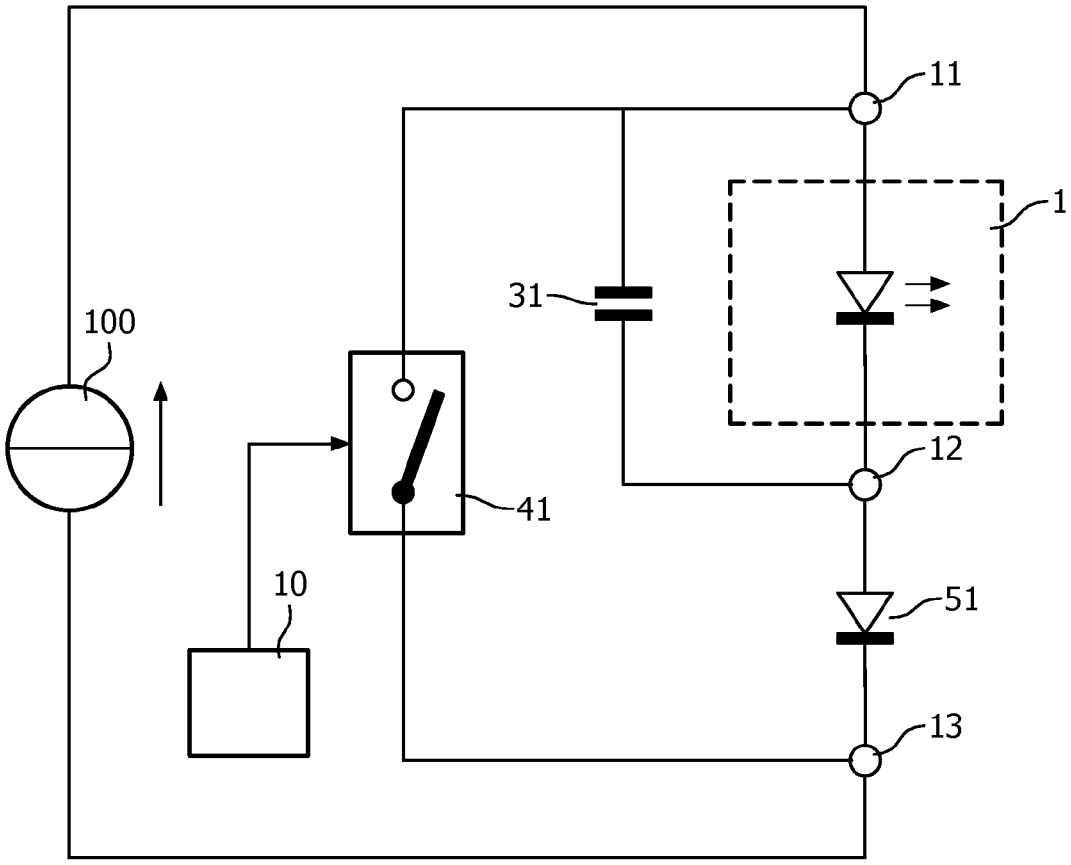
FIG. 1 shows a first embodiment of a device.

In FIG. 1, a first embodiment of a device is shown. The device is connected to a current source 100. One side of the current source 100 is connected to a first terminal 11 that is connected to a first contact of a first switch 41 and to a first contact of a first capacitor 31 and to a first contact of a first light emitting diode circuit 1. A second contact of the first light emitting diode circuit 1 is connected to a second terminal 12 that is connected to a second contact of the first capacitor 31 and to a first contact of a first diode 51. A second contact of the first diode 51 is connected to a further terminal 13 that is connected to a second contact of the first switch 41 and to another side of the current source 100. The first switch 41 is controlled via a controller 10.

Figure 2:
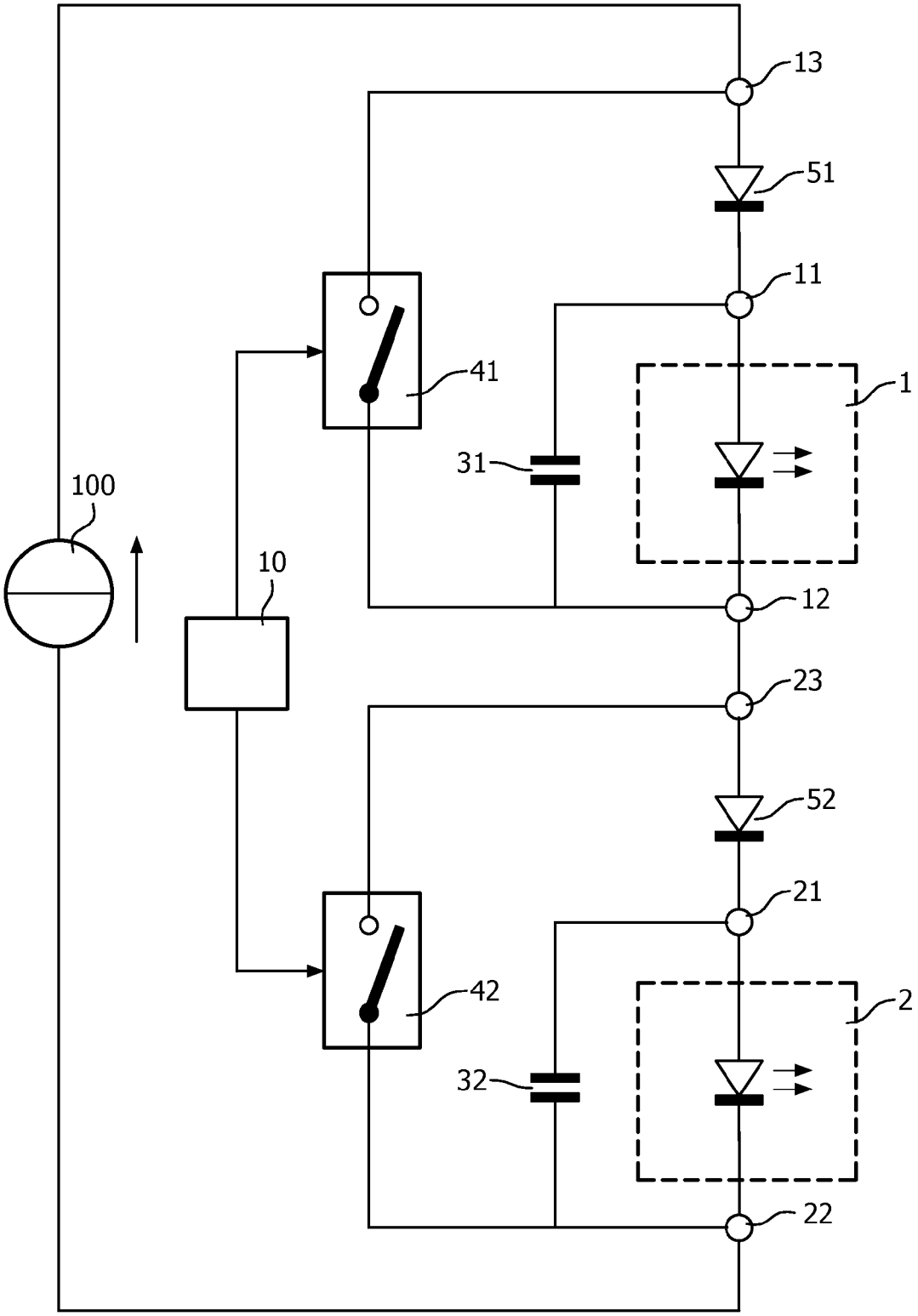
FIG. 2 shows a second embodiment of a device.

In FIG. 2, a second embodiment of a device is shown. The device is connected to a current source 100. One side of the current source 100 is connected to a further terminal 13 that is connected to a first contact of a first switch 41 and to a first contact of a first diode 51. A second contact of the first diode 51 is connected to a first terminal 11 that is connected to a first contact of a first capacitor 31 and to a first contact of a first light emitting diode circuit 1. A second contact of the first light emitting diode circuit 1 is connected to a second terminal 12 that is connected to a second contact of the first capacitor 31 and to a second contact of the first switch 41 and to a yet further terminal 23 that is connected to a first contact of a second switch 42 and to a first contact of a second diode 52. A second contact of the second diode 52 is connected to a third terminal 21 that is connected to a first contact of a second capacitor 32 and to a first contact of a second light emitting diode circuit 2. A second contact of the second light emitting diode circuit 2 is connected to a fourth terminal 22 that is connected to a second contact of the second capacitor 32 and to a second contact of the second switch 42 and to another side of the current source 100. The first and second switches 41 and 42 are controlled via a controller 10.

Each capacitor 31, 32 can be any kind of capacitor. Each switch 41, 42 can be any kind of switch. Each diode 51, 52 can be any kind of diode. Each light emitting diode circuit 1, 2 may comprise one light emitting diode or two or more light emitting diodes in whatever kind of serial and/or parallel construction.

By virtue of the introduction of diodes 51, 52, the capacitors 31, 32 are no longer discharged, when in the conductive mode, via the switches 41, 42. As a result, prior art switches (not shown, see for example US 2010/0194274) to be connected serially to the capacitors 31, 32 (in branches located in parallel to the light emitting diode circuits 1, 2) are no longer required for reducing switch-on delays. In view of this it must be noted that said prior art switches have not just been replaced by said diodes 51, 52 in an obvious way. In addition, the diodes 51, 52 had to be given different locations (outside said branches).

The controller 10 controls the switches 41, 42 in response to information, for example, such that the light emitting diode circuits 1, 2 together provide an overall color temperature that is independent of a component temperature and/or a dimming mode. To achieve this, the light emitting diode circuits 1, 2 may each provide light of different color temperatures, and the information may be derived from a table and/or from a measurement of an overall light intensity or from measurements of individual light intensities per light emitting diode circuit 1, 2 and/or from a measurement of an overall current or from measurements of individual currents per light emitting diode circuit 1, 2 etc.

Clearly, at least one of the first and second and further terminals 11, 12, 13 may coincide with at least one of the third and fourth and yet further terminals 21, 22, 23.

The capacitors 31, 32 may have a smoothing function and/or an equalizing function and/or a buffering function etc. In view of this it must be noted that if said prior art switches, connected serially to the capacitors 31, 32 (in branches located in parallel to the light emitting diode circuits 1, 2), are replaced by diodes (inside said branches) the capacitors 31,32 will lose at least part of their functions.

The devices shown in FIGS. 1 and 2 comprise all components shown usually apart from the current source 100. A device may be sold including the light emitting diode circuit(s) 1, 2 and including or excluding the controller 10. Alternatively, an apparatus may be sold excluding any light emitting diode circuit and including or excluding the controller 10.

Summarizing, an apparatus for driving a light emitting diode circuit 1 comprises first and second terminals 11, 12 to be connected to the light emitting diode circuit 1, a capacitor 31 connected to the first and second terminals 11, 12, a switch 41 for, in a conducting mode, bypassing the light emitting diode circuit 1, and a diode 51 for, in the conducting mode, preventing the capacitor 31 from being discharged via the switch 41. In this way, a reduced switch-on delay is realized without an additional switch being required for activating and deactivating said capacitor 31. The diode 51 is simpler and cheaper and more robust than such an additional switch and does not require a control. Preferably, the apparatus comprises a further terminal 13, wherein the diode 51 is connected to the further terminal 13 and to one of the first and second terminals 11, 12, and the switch 41 is connected to the further terminal 13 and to the other one of the first and second terminals 11, 12.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An apparatus for driving a first light emitting diode circuit, the apparatus comprising first and second terminals to be connected to the first light emitting diode circuit, a first capacitor connected to the first and second terminals, a first switch for, in a first conducting mode, bypassing the first light emitting diode circuit such that no current flows through the first light emitting diode circuit, and a first diode for, in the first conducting mode, preventing the first capacitor from being discharged via the first switch, and a further terminal, the first diode (51) being connected to the further terminal and to one of the first and second terminals, and the first switch being connected to the further terminal and to the other one of the first and second terminals.

2. The apparatus as defined in claim 1, the apparatus further being arranged for driving a second light emitting diode circuit, the apparatus further comprising third and fourth terminals to be connected to the second light emitting diode circuit, a second capacitor connected to the third and fourth terminals, a second switch for, in a second conducting mode, bypassing the second light emitting diode circuit, and a second diode for, in the second conducting mode, preventing the second capacitor from being discharged via the second switch.

3. The apparatus as defined in claim 2, further comprising a yet further terminal, the second diode being connected to the yet further terminal and to one of the third and fourth terminals, and the second switch being connected to the yet further terminal and to the other one of the third and fourth terminals.

4. The apparatus as defined in claim 2, the first and second light emitting diode circuits providing light of different color temperatures, the apparatus further comprising a controller for controlling the first and second switches in response to information for creating an overall color temperature that is independent of a component temperature and/or a dimming mode.

5. A device comprising the apparatus as defined in claim 2 and further comprising the first and second light emitting diode circuits.

6. The device as defined in claim 5, each one of the first and second light emitting diode circuits comprising one light emitting diode or two or more light emitting diodes connected to each other.

7. A device comprising the apparatus as defined in claim 1 and further comprising the first light emitting diode circuit.

8. The device as defined in claim 7, the first light emitting diode circuit comprising one light emitting diode or two or more light emitting diodes connected to each other.

* * * * *